United States Patent [19]

Couture

[11] Patent Number: 4,926,533

[45] Date of Patent: May 22, 1990

[54] PAPER-MAKING WIRE REPAIR KIT

[76] Inventor: Jean Couture, 4025 Courcelles St., Jonquière, Quebec, Canada, G8A 1B6

[21] Appl. No.: 268,540

[22] Filed: Nov. 8, 1988

[51] Int. Cl.[5] ..... B23D 19/00

[52] U.S. Cl. ..... 29/33 F; 29/798; 140/123; 162/DIG. 1

[58] Field of Search ..... 29/402.09, 402.12, 402.14, 29/525.1, 33 F, 798; 140/123, 3 R; 162/348, DIG. 1

[56] References Cited

U.S. PATENT DOCUMENTS

| | | | |
|---|---|---|---|
| 1,749,755 | 3/1930 | Downer | 245/2 |
| 1,792,594 | 2/1931 | Litwin | 245/2 |
| 2,241,257 | 5/1941 | Gronberg | 140/3 R |
| 3,681,841 | 8/1972 | LeBlanc et al. | 29/401 |
| 4,222,162 | 9/1980 | Levy et al. | 29/402.09 |

*Primary Examiner*—Timothy V. Eley

*Attorney, Agent, or Firm*—Pierre Lespérance

[57] ABSTRACT

Paper-making, pulp-dewatering wires or webs are now made of a woven fabric of synthetic resin filaments. Such a fabric is often accidentally perforated. A patch of similar fabric is placed on the perforation and secured to the wire by means of a series of staples. The patch is circular and the legs of the staples are radially directed. The patch is positioned on the paper-contacting face of the wire and the bight of the staples does not protrude from the underside of the wire. An apparatus is disclosed for the insertion of the staples through the wire and the patch.

7 Claims, 3 Drawing Sheets

Fig. 3
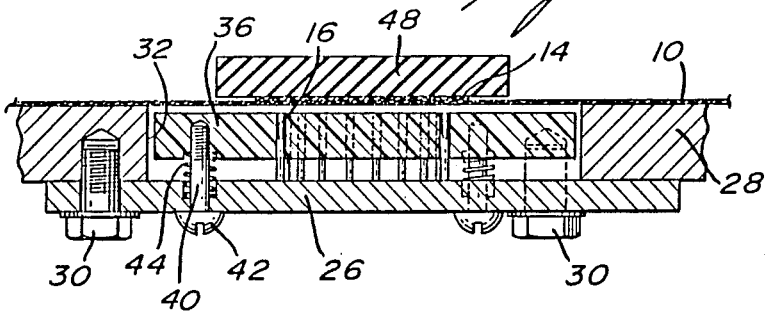
Fig. 4
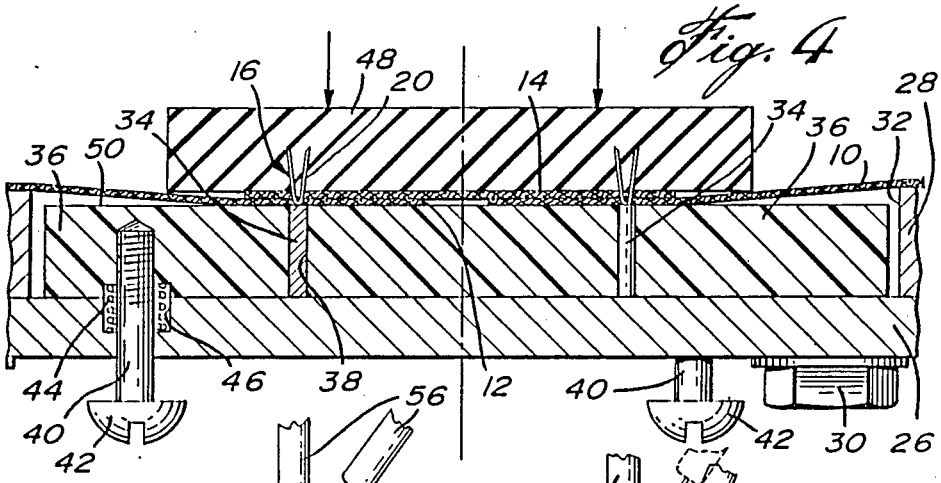
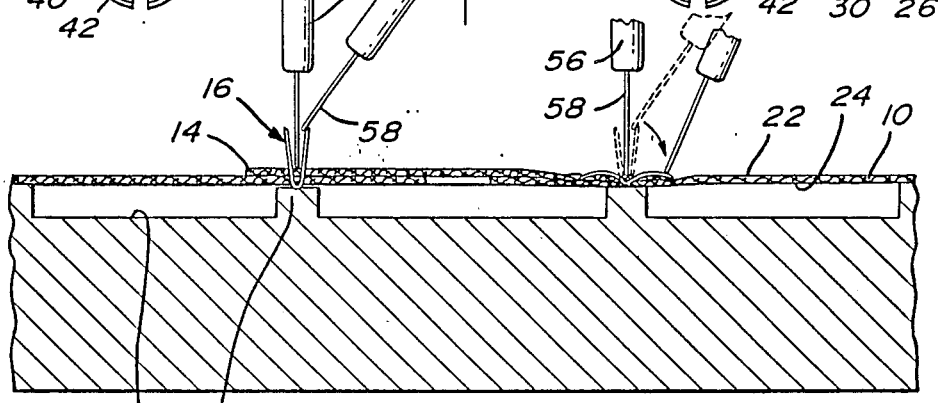
Fig. 5

PAPER-MAKING WIRE REPAIR KIT

FIELD OF THE INVENTION

The present invention relates to a paper-making wire repair kit and, more particularly, to a patch assembly for patching perforations accidentally made in a paper-making wire or pulp-dewatering fabric, and to an apparatus for fixing the patch of the fabric.

BACKGROUND OF THE INVENTION

Paper-making wires used for pulp-dewatering nowadays consist of a woven fabric of fibres of synthetic resin. Such wires are able to become accidentally perforated during use. A perforated fabric causes defects in the paper made therewith and must be replaced or repaired. Such wires are very expensive, since in a paper-making machine, it is not uncommon to find wires of 90 feet long and between 150 and 140 inches wide, and costing $20,000.00 and more. It has been tried—but without good results—to fix a patch onto the perforation of such a wire by means of an adhesive or glue. It has been found that the patch falls away very quickly with use.

OBJECTS OF THE INVENTION

It is the general object of the present invention to fix a patch on a paper-making wire in such a way that the patch will remain attached to the wire for a long time during use of the wire.

Another object of the present invention is to provide a patch and the means to fix the patch to the wire, so arranged that they only slightly protrude from the pulp-contacting face of the wire, so as to produce paper without any defect which could be caused by the patch, or the means to attach the same to the wire.

Another object of the present invention is to provide an apparatus for fixing a patch to a paper-making wire, which is of simple construction and easy to operate.

SUMMARY OF THE INVENTION

In accordance with the invention, there is provided the combination of a paper-making, pulp-dewatering wire having a perforation with a patch covering the perforation, the patch being applied against the pulp-contacting face of the wire and coverinq the perforation and an adjacent portion of the wire around the perforation, and metallic U-shaped staples extending through the wire and the patch, with the legs bent against said patch, and the staples disposed around the perforation. Preferably, the patch is of circular shape and the staples disposed in a circle around the perforation, with the legs of the staples outwardly bent and oriented radially of the patch. The bight of the staple preferably does not protrude from the underface of the wire.

The apparatus to fix the patch to the wire by means of the staples, comprises a base plate provided with a plurality of staple-ejecting plungers, a pusher plate disposed over the base plate and having a wire-contacting face and through-bores slidably receiving the plungers; biasing means to move the pusher plate from a retracted to an advanced position, spaced from said base plate, stop means to stop said pusher plate at said advanced position under the bias of said biasing means; and guide means to guide the base plate during its movement between said retracted and advanced position, and wherein the stroke of said pusher plate from its retracted to its advanced position is at least equal to the length of a staple, such that in said advanced position, a staple inserted in a through-bore and contacting the plunger therein, does not protrude from said wire-contacting face of the pusher plate, and in its retracted position, the end of said plunger is at least flush with said wire-contacting face. Preferably, the through-bores have a cross sectional elongated shape, conforminq to the cross-section of a U-shaped staple to positively orient the latter in the through-bores. Preferably, a soft pad is arranged to be applied on the patch opposite the pusher plate to press the latter to its retracted position while compressing the patch on the wire, causing ejection of the staples and insertion of their legs through said wire and patch and into said pad, thereby causing compression of the wire by the bight of the staples. The legs of the wire are bent outwardly by means of suitable tools.

BRIEF DESCRIPTION OF THE DRAWINGS

FIG. 3 is a cross-section taken along line 3—3 of FIG. 2, with the rubber pad in position, and showing the pusher plate in advanced position;

FIG. 4 is a view similar to that of FIG. 3, on an enlarged scale, and showing the pusher plate in retracted position, with the staples inserted through the wire and the patch, and into the pad;

FIG. 5 shows the tooling to bend the legs of the staples outwardly;

In the drawings, like reference numerals indicate like elements throughout.

DETAILED DESCRIPTION OF THE PREFERRED EMBODIMENT

Referring to FIGS. 1, 2, 6, and 7, there is shown a paper-making wire, indicated at 10, of conventional construction. Such wires usually consist of a woven fabric of synthetic resin fibres, such as nylon. This wire forms an endless band used in Foudrinier paper-making machines, in which the band is horizontal, or used in newer types of paper-making machines, such as the twin wires former in which the pulp coming from the head box of the machine as a water suspension, is squeezed between the two vertical runs of the wires, and the pulp is dewatered by exit of the water through the interstices of the fabric. Such papermaking machines are made, for instance, by BLACK CLAWSON PAFER MACHINE DIVISION. of Watertown, N.Y., under the general trade mark VERTI-FORMA. The face of the wire from which the water exits, that is the face of the wire opposite the pulp-contacting face, is subjected during travel of the wire to a scraping action effected by stationary blades, called foils, generally made of ceramic.

It frequently happens during paper-making that such wires become perforated due, for instance, to the accidental presence of small metal objects in the head box, or for whatever other reason. Such perforations produce defects in the paper made therefrom. Attempts have been made to try to patch the perforations with patches adhering to the wire by means of glue or the like. Such patches are soon dislodged during use of the wire.

Figure 1:
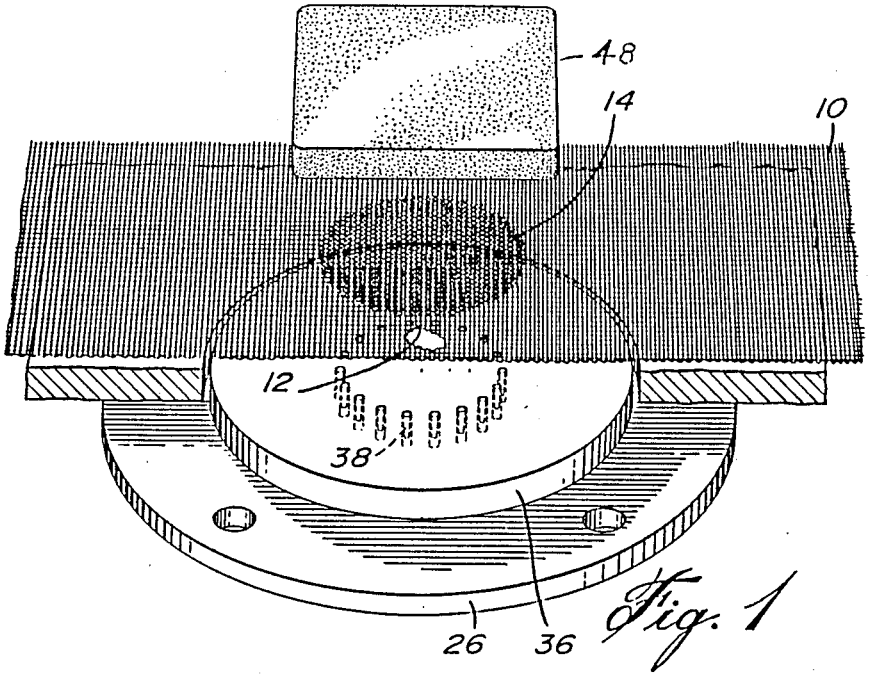
FIG. 1 is an exploded, partial perspective view showing the paper-making wire having a perforation, a patch to cover said perforation and the apparatus for fixing the patch to the wire by means of staples.
Figure 2:
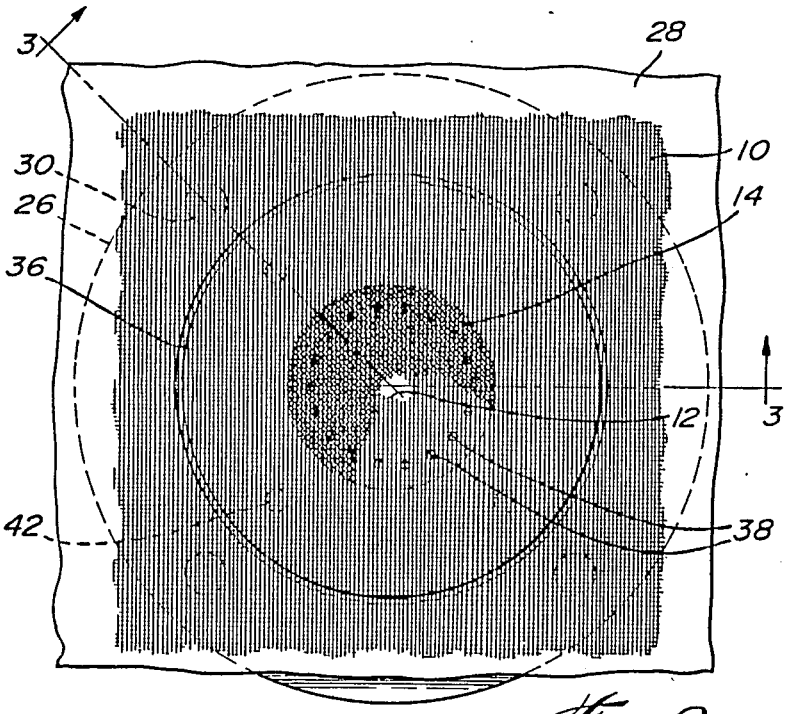
FIG. 2 is a top plan view of the arrangement of FIG. 1, but without the overlying rubber pad.

FIG. 1 shows at 12 a perforation made in the wire or fabric 10. In accordance with the invention, a patch 14 is applied over the perforation 12. This patch may have a rectangular or square shape, but with rounded corners, and is preferably of circular shape, as shown. This patch is made of a material similar to that of fabric 10, but preferably of smaller thickness. The patch is of sufficient size to overly the area of the fabric 10 surrounding the perforation 12 to receive fasteners disposed around the perforation 12.

In accordance with the invention, such fasteners consist of metallic staples 16, each of U-shape, comprising a bight 18 and a pair of legs 20.

Figure 6:
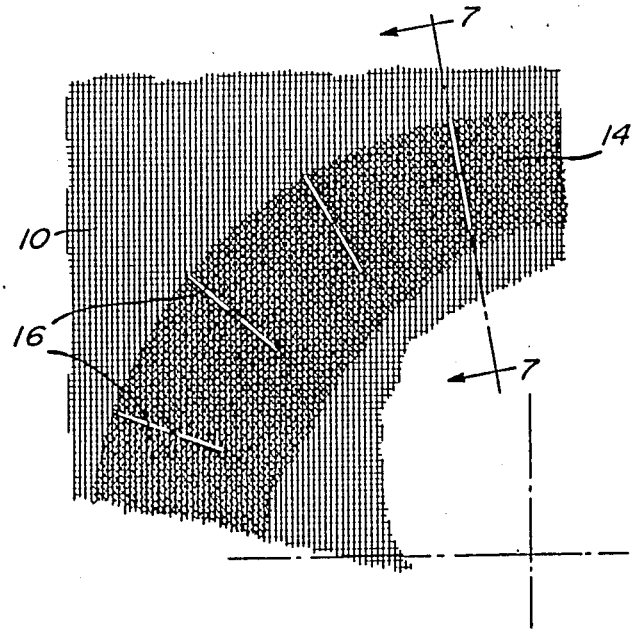
FIG. 6 is a partial plan view of the wire and patch in assembled position.
Figure 7:
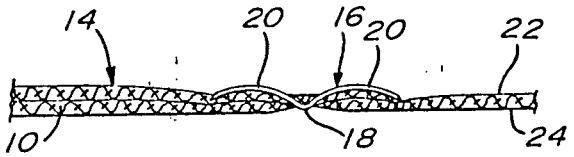
FIG. 7 is a partial cross-section, taken along line 7—7 of FIG. 6.

The wire 10 has a pulp-contacting face 22 and an opposite face 24, against which the foils are adapted to scrape. The patch 14 is positioned over the pulp-contacting face 22. When the patch is assembled by the staples 16, as shown in FIGS. 6 and 7, the bight 18 of each staple engages the opposite face 24 and the legs extend through the wire 10 and the patch 14, and the legs 20 are outwardly bent and curved with their outer ends digging into the fabric of the patch 14, as clearly shown in FIG. 7. Since the bight 18 compresses the thickness of the wire 10, it does not protrude from the remaining opposite face 24 and, therefore, the bights 18 will not be affected by the foils of the paper-making machine.

Preferably, the staples 16 are equally, angularly spaced around the patch as shown in FIG. 6, and their legs, which are outwardly bent, are radially directed. With this arrangement, the patch is firmly held to the wire 10 and the patch and staples will not cause defects in the paper made with the patched wire, as has been tested in several experiments made in Canada.

Obviously, more than one circular row of staples 16 may be used, with all the circles of staples being generally concentric with the perforation 12.

FIGS. 1 to 5 show a preferred apparatus for securing the patch to the wire by means of the staples 16. This apparatus comprises a circular base plate 26 secured to the underside of a table 28 by means of bolts 30 and straddling an opening 32, made in the table 28. The table is used to support the wire 10 with its perforation 12 over opening 32, the wire being placed on the table with its pulp-contacting face 22 on top.

A plurality of plungers 34 are secured to the base plate 26 and upwardly extend therefrom. A pusher plate 36 is disposed over the base plate 26 and has a plurality of throughbores 38, each slidably receiving a plunger 34. The pusher plate 36 is guided for up-and-down movement by means of guide bolts 40 screwed within the pusher plate 36 and slidably extending through a through-bore made in the base plate 26, with the head 42 of the bolt underneath the latter. The head 42 of the guide bolts serves as a stop means to limit the upward movement of the pusher plate to an advanced position, slightly below the top face of the table 28.

Compression coil springs 44 surround each bolt 40, abut against the underside of the pusher plate 36 and against the shoulder formed by a countersunk portion of the through-bore for the guide bolts 40, as shown at 46. Thus, the pusher plate 36 can take a retracted position, as shown in FIG. 4, against the bias of the coil springs 44, and in which the pusher plate abuts against the base plate 26.

The apparatus further includes a soft pad 48, of a size sufficient to extend beyond the patch 14. This pad 48 is made of soft material, preferably elastomeric material, such as rubber, for easy insertion of the legs 20 of the staples 16, without bending of the same.

In the advanced position of the pusher plate, one inserts a staple in each through bore 38 of the pusher plate 36, with the bight 18 contacting the end of the plunger 34 and, therefore, with the legs 20 of each staple being upwardly directed.

The stroke of the pusher plate from its retracted to its advanced position is at least equal to the length of each staple 16. Therefore, in the advanced position of the pusher plate, each staple inserted in its through-bore 38 does not protrude from the wire-contacting face 50 of the pusher plate 36, and yet in the retracted position of the pusher plate, the end of the plunger is at least flush with the wire contacting face 50. as shown in FIG. 4.

To operate the apparatus, the wire 10 is placed on the table 28, with the perforation 12 to be patched over the pusher plate. The patch 14 is placed over the perforation 12. Fad 48 is placed over the patch 14 and then pressed downwardly, as shown in FIG. 4, whereby the assembly of the wire 10 and patch 14 is forced against face 50 of the pusher plate 46, and the latter is pushed down against base plate 26 against the bias of the coil springs 44, whereby all of the staples 16 are pushed up through the wire 10 and patch 14, and their legs 20 enter the pad 48. The assembly is then shifted over a recessed portion 52 of table 2B provided with a circular ridge 54. The circular row of staples 16 is placed in register with ridge 54. A pair of handtools 56, each terminated by a flat blade 58 are used, after removal of pad 48, to press against biqht lB and to individually ben each leg 20 of each staple 16 radially outwardly against the patch 14.

Although the through-bores 38 are shown as of rounded cross-sectional shape, it is preferred to make them of elongated cross-sectional shape, together with the plungers 34, such a shape conforming to the cross-sectional shape of a staple 16, so as to automatically orient the staples, so that their legs 28 would be, without any difficulty, bent radially outwardly along radial lines of the patch 14.

I claim:

1. An apparatus for use with U-shaped staples of substantially same dimensions and consisting of a bight and of two legs, said apparatus destined to fix a patch onto a face of a paper-making pulp dewatering wire to cover a perforation of said wire and comprising:

a base plate;

a plurality of staple-ejecting plungers fixed to, and upstanding from, said base plate, a pusher plate disposed over said base plate, having a wire-contacting face and having through-bores slidably receiving said plungers, biasing means to move said pusher plate from a retracted to an advanced position, spaced from said base plate, stop means to stop said pusher plate at said advanced position under the bias of said biasing means, and guide means to guide said pusher plate during its movement between said retracted and said advanced position; and wherein the stroke of said pusher plate from its retracted to its advanced position is at least equal to the length of a staple, such in said advanced position, a stapler inserted in a through-bore and contacting the plunger therein, does not protrude from said wire-contacting face of said pusher plate, and in its retracted position, the end of said plunger is at least flush with said wire-contacting face.

2. An apparatus as defined in claim 1, wherein each through-bore has a cross-sectionally-elongated shape conforming to the cross-section of the U-shaped staple to positively orient the latter in said through-bore.

3. An apparatus as defined in claim 1, wherein said through-bore are arranged in a circle in said pusher plate.

4. An apparatus as defined in claim 3, wherein each through-bore has a cross-sectionally-elongated shape conforming to the cross-section of a U-shaped staple to positively orient the latter in said through-bore.

5. An apparatus as defined in claim 4, wherein said through-bore are radially oriented relative to the center of said circle.

6. An apparatus as defined in claim 1, further including a soft pad arranged to be applied onto said patch opposite said pusher plate to press the latter to its retracted position while compressing said patch onto said wire, causing ejection of said staples and insertion of their legs through said patch and wire, and into said pad with said bight engaging under said wire.

7. An apparatus as defined in claim 6 and further including tool means to bend said legs over and against said patch.

* * * * *